US005174579A

United States Patent [19]

Griffiths

[11] Patent Number: 5,174,579

[45] Date of Patent: Dec. 29, 1992

[54] MODIFIED METHOD OF PLAYING A TWENTY-ONE GAME

[76] Inventor: Steve Griffiths, 4708 E. Rochelle, Las Vegas, Nev. 89121

[21] Appl. No.: 802,330

[22] Filed: Dec. 4, 1991

[51] Int. Cl.[5] ..... A63F 1/00

[52] U.S. Cl. ..... 273/292

[58] Field of Search ..... 273/292, 274, 303-306

[56] References Cited

U.S. PATENT DOCUMENTS

| | | | |
|---|---|---|---|
| 4,614,342 | 9/1986 | Takshima | 273/85 CF |
| 4,651,997 | 3/1987 | Wood | 273/274 |
| 4,836,553 | 6/1989 | Suttle et al. | 273/292 |
| 4,861,041 | 8/1989 | Jones et al. | 273/292 |

OTHER PUBLICATIONS

Scarne's Encyclopedia of Games by John Scarne, Harper & Row, publishers, 1973, pp. 276-282.

Royal Match 21 Brochure.

Fortune Card 21 Brochure.

*Primary Examiner*—Benjamin H. Layno

*Attorney, Agent, or Firm*—John E. Roethel

[57] ABSTRACT

An additional separate wager is added to a conventional Twenty-One game. The player is wagering on whether the dealer will either bust on his hand or achieve a hand count of exactly 21. The Twenty-One game is played out according to the conventional method of play of the game and the normal winning and losing hands are paid or collected by the dealer. The dealer then reconciles the additional separate wagers based on whether the dealer has either busted or achieved a hand count of exactly 21 during the play of the dealer's hand. This additional wager can be paid according to predetermined odds, such as one-to-one odds or others, as determined by the house.

25 Claims, No Drawings

MODIFIED METHOD OF PLAYING A TWENTY-ONE GAME

This invention relates to a modified Twenty-One game, and more particularly to a modified Twenty-One game in which an additional wager is permitted with the outcome of the additional wager determined by whether the dealer achieves exactly a count of 21 or busts.

BACKGROUND OF THE INVENTION

Twenty-One (also called Blackjack) is a staple of most casinos. Conventional Twenty-One involves a game of chance between a dealer and one or more players. The object is for the player to achieve a count of his hand closer to 21 than the count of the hand of the dealer; but if the count of the player's hand goes over 21 then the player loses regardless of the final count of the dealer's hand.

A standard deck of playing cards is used and each card counts its face value, except Aces which have a value of one or eleven as is most beneficial to the count of the hand. Both the dealer and the player initially receive two cards. One of the dealer's cards is dealt face down and the other of the dealer's cards is dealt face up. The player may draw additional cards (take "hits") in order to try and beat the count of the dealer's hand. If the player's count exceeds 21, the player "busts." After all of the players have taken hits or have stood on their hand, the dealer "stands" or "hits" based on pre-established rules for the game. Typically, if the dealer has less than 17, the dealer must take a hit. If the dealer has 17 or more, the dealer stands. The closest to a 21 count, without going over, wins; tie hands are a "push."

One modification that is often permitted in a conventional Twenty-One game is what is known as "Insurance." The player has the opportunity to make an "insurance" bet when the dealer's face up card is an Ace. These insurance bets are made after each player and the dealer receives their first two cards and before any additional cards are dealt. When the dealer's face up card is an Ace, each player can wager one-half of the amount of his original wager as insurance against the player having a Blackjack, i.e. a two-card 21 count (an Ace and a 10 count card such as a King, Queen, Jack or Ten). Insurance bets are usually only permitted when the dealer's "up" card is an Ace.

If the dealer has a two-card 21 count, the player loses on his original wager but wins two-to-one odds on his second "insurance" bet. Also if the dealer has a two-card 21 count, the round of the game is over and all players lose except those who also have two-card 21 counts. If the dealer does not have a two-card 21 count, the player loses on his "insurance" bet and the round of the game continues.

Twenty-One has remained remarkably unchanged over the years. There have been a few other modifications proposed to the basic game, but none of these modifications have achieved universal popularity. For example, in the conventional Twenty-One game, the dealer shows one (the "up" card) of his first two cards and the other card (the "hole" card) is kept hidden until all the players have drawn to their hands. One modification involves the dealer showing both of his cards face up before the players draw. This improves the player's odds of winning and the payout odds have been modified to adjust for this change so that the house's advantage remains.

Recently a Twenty-One game known as "Royal Match 2I" has been introduced. A player makes a separate bet to be eligible for the Royal Match feature of the game. If the player's first two cards are of the same suit, the player is an instant winner and receives whatever the posted payout is. If the player's first two cards are the Ace and King of the same suit, the player wins whatever the posted Royal Match payout is. The separate Royal Match bets are placed in a separate jackpot and the player wins half of the jackpot amount for a Royal Match. The house retains the remainder of the jackpot.

Another recently introduced Twenty-One game is "Fortune Card 21." In this game, extra Fortune Cards of various colors are added to a standard playing deck of cards. Whenever a Fortune Card is dealt, each player has the option of making a separate Fortune Card bet. If the next card dealt is also a Fortune Card, each player who has made a Fortune Card bet is a winner. The amount won depends on the colors of the Fortune Cards. The separate Fortune Card bets are placed in a separate jackpot and the players win portions of the jackpot amount for winning Fortune Card events. One-half of the Fortune Card jackpot is retained by the house.

U.S. Pat. No. 4,861,041 (Jones et al.) discloses a Twenty-One game in which the player may make a separate bet at the beginning of the game in order to be eligible for a separate jackpot. Those players who have made this separate bet can win all of part of the jackpot if the player's cards correspond to certain predetermined hands. For example, if a player achieves four 5's and an Ace, the player can win 100% of the jackpot. If the player achieves an Ace, Two, Three, Four, Five and Six, the player wins 10% of the jackpot. Other combinations can pay other percentages or flat amounts from the jackpot. The amount of this side jackpot continues to progress until all or part of the jackpot is won by a player.

The disadvantage of conventional Twenty-One is that, once the player draws his cards and exceeds a count of 21 (i.e. the player busts), the player has no further interest in what occurs during the remainder of the round. Once the player "busts", he has lost and nothing else that happens can change the fact that the player has lost. It can be very frustrating to the player to be sitting at a Twenty-One table after the player has "busted" and have the dealer also "bust."

It can also be very disappointing for the player to be dealt or draw to a hand count of 19 or 20, and have the dealer achieve a card count of 21. There is a need in Twenty-One for a modification in which the player has the opportunity to make an additional wager on whether the dealer will achieve exactly a hand count of 21 or bust.

It is an object of the present invention to provide a form of Twenty-One in which the player still has a chance to win even if the player has busted on his own hand and the dealer achieves a hand count of exactly 21.

It is a feature of the present invention to provide a separate wager that allows the player to bet whether or not the dealer will bust or achieve a hand count of exactly 21. This wager is independent of what happens on the player's own hand. There are no modifications to the regular method of play of Twenty-One; the players and the dealer play out their hands as would normally occur and the determination of this separate bet is made at the end of the round.

It is an advantage of the present invention that the player has the opportunity to win if the dealer busts his hand or achieves a hand count of exactly 21, even if the player has busted on his own hand. This maintains player interest in the game until the end of the round. This also gives the player the opportunity to win twice on the same round; the player can achieve a winning Twenty-One hand and the player can also win if the dealer busts.

SUMMARY OF THE INVENTION

An additional separate wager, referred to as a "21 or over" wager, is added to a conventional Twenty-One game. The player is wagering on whether the dealer will either bust or achieve a hand count of exactly 21. The Twenty-One game is played out according to the conventional method of play of the game and the normal winning and losing hands are paid or collected by the dealer. The dealer then reconciles the additional separate "21 or over" wagers based on whether the dealer has either busted or achieved a hand count of exactly 21 during the play of the dealer's hand. This additional "21 or over" wager can be paid according to predetermined odds, such as one-to-one odds or others, as determined by the house.

DETAILED DESCRIPTION OF THE PREFERRED EMBODIMENTS

The player makes a first wager to be eligible to participate in the standard conventional Twenty-One game. The player also has the option to make an additional separate "21 or over" wager. The player is making this additional wager on whether the dealer will either bust or achieve exactly a hand count of 21 on the dealer's hand.

This additional "21 or over" bet can be made anytime before the dealer exposes his "hole" and shows his initial two card count. The player may make this additional bet at the same time that he makes his first bet to be eligible to play the round of Twenty-One or the player may wait until he plays out his own hand or the player may wait until the dealer is about to turn up his "hole" card.

The standard Twenty-One game is played out according to the conventional method of play of the game and the normal winning and losing hands are paid or collected by the dealer. If the player is allowed to split his hand into more than one hand (such as in the situation when the player receives a pair as his first two cards), then the player will also have the option of making additional wagers covering the extra hand he is now playing, as is conventional in Twenty-One. The payouts on the regular Twenty-One wagers are according to the standard payouts used in a conventional Twenty-One game. If the player has split his cards into more than one hand, the player may also have the option of making separate additional "21 or over" wagers on each of his resulting hands.

The dealer then reconciles the additional separate "21 or over" wagers based on whether the dealer has either busted or achieved a hand count of exactly 21 during the play of the dealer's hand. This additional "21 or over" wager can be paid according to predetermined odds as determined by the house.

In one of the preferred embodiments of the present invention, the predetermined odds would be one-to-one based on the amount that has been bet by the player for the "21 or over" wager. Depending on the percentage that the house wishes to retain, other odds could be used such as three-to-two odds or two-to-one odds.

This separate "21 or over" wager is still active even if all of the players at the table bust on their hands. If all of the players at the table have gone over a hand count of 21, the dealer continues to play out his hand according to the standard Twenty-One rules as to whether the dealer must "hit" or "stand." If the dealer either busts or achieves a hand count of exactly 21, then each player who has made this second separate "21 or over" wager would win and the dealer pays that wager based on the predetermined odds set by the house. As is established by the standard method of play of Twenty-One, if the dealer achieves a hand count of 17, 18, 19 or 20, he is no longer allowed to take a hit. In such an instance the dealer has not achieved a hand count total of 21 or over and the player loses this separate "21 or over" wager and the house retains the amount of those wagers.

In another preferred embodiment of the present invention, the additional "21 or over" wager would only be a win for the player if the dealer draws to a hand count of 21, i.e. the dealer has three or more cards that add up to a hand count of or the dealer busts. If the dealer has a two-card total hand count of 21, then the additional "21 or over" wager would be declared a tie bet or a "push." This embodiment would result in an increased percentage for the house, which would allow the house to pay higher than one-to-one odds on the additional "21 or over" wager.

In yet another preferred embodiment of the present invention, a two-to-one payout can be made for winning "21 or over" wagers; but the method of play is modified regarding what particular circumstances result in winning and losing "21 or over" wagers. In this modified method of play, the additional "21 or over" wager is a push if the dealer's "up" card is an Ace and the dealer also has a Blackjack (two-card 21 hand count.) The player wins the two-to-one payout odds on the additional "21 or over" wager if the dealer busts or if the dealer's "up" card is a ten count card (King, Queen, Jack or Ten) and the dealer has a Blackjack. The player loses on the additional "21 or over" wager if the dealer hits to 17, 18, 19, 20 or 21.

The house may impose limits on the amount of the separate "21 or over" wager in any of the above-described embodiments of the invention just as the house often imposes limits on the amount of the standard wager made to be eligible to play the Twenty-One hand.

The additional "21 or over" wager does not interfere with the regular play of the game of Twenty-One. Players may still split pairs, double-down, take insurance and do any of the other techniques that are used in the play of Twenty-One. The present invention allows the player another chance to win while engaged in the game of Twenty-One.

The invention is also applicable to any game in which the dealer has to achieve a certain numerical hand count without going over that numerical count. In accordance with the present invention, the player may be provided, in addition to the first wager to be eligible to participate in the standard game, with the option of making an additional wager that the dealer will either achieve the desired hand count or go over that count ("bust"). The player would win or lose on the standard game according to the standard rules of play of the game. The player would also win on his optional wager if the dealer either achieved the desired numerical hand count or exceeded the numerical count.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of including a separate wagering feature in a standard game of Twenty-One comprising the steps of:

a) a player making a first wager to participate in the standard game of Twenty-One, b) a player making a second wager that the dealer will either bust or achieve a hand count of exactly 21 with a hand of three or more cards, c) the player participating in the standard game of Twenty-One conducted according to the standard method of play, and d) the player winning on his second wager if the dealer either busts or achieves a hand count of exactly 21 with a hand of three or more cards.

2. The method of claim 1 wherein the player wins predetermined odds on his second wager.

3. The method of claim 2 wherein the predetermined odds are one-to-one.

4. The method of claim 2 wherein the predetermined odds are two-to-one.

5. The method of claim 2 wherein the predetermined odds are three-to-two.

6. The method of claim 1 wherein the player may make the second wager at anytime during the play of the game before the dealer turns up his hole card.

7. A method of including a separate wagering feature in a standard game of Twenty-One comprising the steps of:

a) a player making a first wager to participate in the standard game of Twenty-One, b) a player making a second wager that the dealer will either bust or achieve a hand count of exactly 21 with a hand of three or more cards, c) the dealer dealing a two-card hand to the player and a two-card hand to the dealer, d) the player having the option of standing or drawing additional cards until the player achieves a hand count acceptable to the player, e) the dealer either standing or taking additional cards according to a pre-established procedure, f) the player winning or losing on his first wager according to the standard method of play of Twenty-One and, if the player wins, he is paid the standard Twenty-One payouts for his first wager, and g) the player winning on his second wager if the dealer either busts or achieves a hand count of exactly 21 with a hand of three or more cards.

8. The method of claim 7 wherein the player wins predetermined odds on his second wager.

9. The method of claim 8 wherein the predetermined odds are one-to-one.

10. The method of claim 7 wherein the pre-established procedure is that the dealer draws cards until his hand count is 17 or greater.

11. A method of including a separate wagering feature in a standard game of Twenty-One comprising the steps of:

a) a player making a first wager to participate in the standard game of Twenty-One, b) a player making a second wager that the dealer will either bust or achieve a hand count of exactly 21, c) the dealer dealing a two-card hand to the player and a two-card hand to the dealer, d) the player having the option of standing or drawing additional cards until the player achieves a hand count acceptable to the player, e) the dealer either standing or taking additional cards according to a pre-established procedure, f) the player winning or losing on his first wager according to the standard method of play of Twenty-One and, if the player wins, he is paid the standard Twenty-One payouts for his first wager, g) the player pushing on his second wager if the dealer achieves a two-card hand count of exactly 21, and h) the player winning on his second wager if the dealer either busts or achieves a hand count of exactly 21 with a hand of three dr more cards.

12. The method of claim 11 wherein the player wins predetermined odds on his second wager.

13. The method of claim 12 wherein the predetermined odds are one-to-one.

14. The method of claim 11 wherein the pre-established procedure is that the dealer draws cards until his hand count is 17 or greater.

15. The method of claim 11 wherein the player may make the second wager at anytime during the play of the game before the dealer turns up his hole card.

16. A method of including a separate wagering feature in a standard game of Twenty-One comprising the steps of:

a) a player making a first wager to participate in the standard game of Twenty-One, b) a player making a second wager that the dealer will either bust or achieve a hand count of exactly 21, c) the dealer dealing a two-card hand to the player and a two-card hand to the dealer, d) the player having the option of standing or drawing additional cards until the player achieves a hand count acceptable to the player, e) the dealer either standing or taking additional cards according to a pre-established procedure, f) the player winning or losing on his first wager according to the standard method of play of Twenty-One and, if the player wins, he is paid the standard Twenty-One payouts for his first wager, g) the player pushing on his second wager if the dealer has an Ace as his "up" card and the dealer achieves a two-card hand count of exactly 21, and h) the player winning on his second wager either if the dealer busts or if the dealer has a ten count card as his "up" card and achieves a two-card hand count of exactly 21 or if the dealer achieves a hand count of exactly 21 with a hand of three or more cards.

17. The method of claim 16 wherein the player wins predetermined odds on his second wager.

18. The method of claim 17 wherein the predetermined odds are two-to-one.

19. The method of claim 16 wherein the pre-established procedure is that the dealer draws cards until his hand count is 17 or greater.

20. The method of claim 16 wherein the player may make the second wager at any time during the play of the game before the dealer turns up his "hole" card.

21. A method of including a separate wagering feature in any standard card game in which the dealer must achieve a certain numerical count without going over the numerical count comprising the steps of:

a) a player making a first wager to participate in the standard card game, b) a player making a second wager that the dealer either achieves the certain numerical count with a hand of three or more cards or exceeds the numerical count, c) the player participating in the standard card game conducted according to the standard method of play, and d) the player winning on his second wager if the dealer either achieves the certain numerical count with a hand of three or more cards or exceeds the numerical count.

22. The method of claim 21 wherein the player wins predetermined odds on his second wager.

23. A method of including a separate wagering feature in a standard game of Twenty-One comprising the steps of:

a) a player making a first wager to participate in the standard game of Twenty-One, b) a payer making a second wager that the dealer will either bust or achieve a hand count of exactly 21, the second wager being made at anytime during the play of the game before the dealer turns up his hole card, c) the player participating in the standard game of Twenty-One conducted according to the standard method of play, and d) the player winning on his second wager if the dealer either busts or achieves a hand count of exactly 21.

24. A method of including a separate wagering feature in a standard game of Twenty-One comprising the steps of:

a) a player making a first wager to participate in the standard game of Twenty-One, b) a player making a second wager that the dealer will either bust or achieve a hand count of exactly 21, the second wager being made at anytime during the play of the game before the dealer turns up his hole card, c) the dealer dealing a two-card hand to the player and a two-card hand to the dealer, d) the player having the option of standing or drawing additional cards until the player achieves a hand count acceptable to the player, e) the dealer either standing or taking additional cards according to a pre-established procedure, f) the player winning or losing on his first wager according to the standard method of play of Twenty-One and, if the player wins, he is paid the standard Twenty-One payouts for his first wager, g) the player pushing on his second wager if the dealer achieves a two-card hand count of exactly 21, and h) the player winning on his second wager if the dealer either busts or achieves a hand count of exactly 21 with a hand of three or more cards.

25. A method of including a separate wagering feature in a standard game of Twenty-One comprising the steps of:

a) a player making a first wager to participate in the standard game of Twenty-One, b) a player making a second wager that the dealer will either bust or achieve a hand count of exactly 21, the second wager being made at anytime during the play of the game before the dealer turns up his hole card, c) the dealer dealing a two-card to the player and a two-card hand to the dealer, d) the player having the option of standing or drawing additional cards until the player achieves a hand count acceptable to the player, e) the dealer either standing or taking additional cards according to a pre-established procedure, f) the player winning or losing on his first wager according to the standard method of play of Twenty-One and, if the player wins, he is paid the standard Twenty-One payouts for his first wager, g) the player pushing on his second wager if the dealer has an Ace as his "up" card and the dealer achieves a two-card hand count of exactly 21, and h) the player winning n his second wager if the dealer either busts or if the dealer has a ten count card as his "up" card and achieves a two-card hand count of exactly 21.

* * * * *